US010149048B1

(12) United States Patent
Stefanakis et al.

(10) Patent No.: US 10,149,048 B1
(45) Date of Patent: Dec. 4, 2018

(54) DIRECTION OF ARRIVAL ESTIMATION AND SOUND SOURCE ENHANCEMENT IN THE PRESENCE OF A REFLECTIVE SURFACE APPARATUSES, METHODS, AND SYSTEMS

(71) Applicant: Foundation for Research and Technology—Hellas (FORTH), Heraklion, Crete (GR)

(72) Inventors: Nikolaos Stefanakis, Crete (GR); Athanasios Mouchtaris, Crete (GR)

(73) Assignee: FOUNDATION FOR RESEARCH AND TECHNOLOGY—HELLAS (F.O.R.T.H.) INSTITUTE OF COMPUTER SCIENCE (I.C.S.), Heraklion (GR)

( * ) Notice: Subject to any disclaimer, the term of this patent is extended or adjusted under 35 U.S.C. 154(b) by 130 days.

(21) Appl. No.: 15/276,785

(22) Filed: Sep. 26, 2016

Related U.S. Application Data

(63) Continuation-in-part of application No. 15/183,538, filed on Jun. 15, 2016, which is a continuation of application No. 15/001,190, filed on Jan. 19, 2016, now abandoned, which is a continuation-in-part of application No. 14/556,038, filed on Nov. 28, 2014, now Pat. No. 9,549,253, which is a continuation-in-part of application No. 14/294,095, filed on Jun. 2, 2014, which is a continuation-in-part (Continued)

(51) Int. Cl.
*H04R 3/00* (2006.01)

(52) U.S. Cl.
CPC ..... *H04R 3/005* (2013.01); *H04R 2430/23* (2013.01)

(58) Field of Classification Search
None
See application file for complete search history.

(56) References Cited

U.S. PATENT DOCUMENTS 7,555,161 B2 6/2009 Haddon et al.
7,826,623 B2 11/2010 Christoph (Continued)

OTHER PUBLICATIONS

H. K. Maganti, D. Gatica-Perez, I. McCowan, "Speech Enhancement and Recognition in Meetings with an Audio-Visual Sensor Array," IEEE Transactions on Audio, Speech, and Language Processing, vol. 15, No. 8, Nov. 2007.

(Continued)

*Primary Examiner* — Paul Huber
(74) *Attorney, Agent, or Firm* — Norton Rose Fulbright US LLP

(57) ABSTRACT

A processor-implemented method for sound-source enhancement, including: capturing a signal from a sound source using a sensor array having a plurality of sensors, the sensor array being positioned between the sound source and the reflective surface; calculating a half-space propagation model by determining a modified steering vector associated with a plane sound wave produced by the sound source as a function of signal direction and the reflectivity value; calculating a half-space spatial coherence model by dividing a sphere with its center on the reflecting surface into two mirror symmetric parts intersected by a plane to create two half spheres; creating a half-space signal-enhancement module using the half-space propagation model and the half-space coherence model; and applying the half-space signal-enhancement module to the signal.

20 Claims, 11 Drawing Sheets

Related U.S. Application Data of application No. 14/038,726, filed on Sep. 26, 2013, now Pat. No. 9,554,203.

(60) Provisional application No. 62/232,284, filed on Sep. 24, 2015, provisional application No. 61/706,073, filed on Sep. 26, 2012.

(56) References Cited

U.S. PATENT DOCUMENTS

| | | | |
|---|---|---|---|
| 8,073,287 | B1 | 12/2011 | Wechsler et al. |
| 8,923,529 | B2 | 12/2014 | McCowan |
| 2008/0089531 | A1 | 4/2008 | Koga et al. |
| 2009/0080666 | A1 | 3/2009 | Uhle et al. |
| 2010/0135511 | A1 | 6/2010 | Pontoppidan |
| 2010/0142327 | A1 | 6/2010 | Kepesi et al. |
| 2010/0217590 | A1 | 8/2010 | Nemer et al. |
| 2010/0278357 | A1 | 11/2010 | Hiroe |
| 2011/0033063 | A1 | 2/2011 | McGrath et al. |
| 2011/0091055 | A1 | 4/2011 | LeBlanc |
| 2011/0110531 | A1 | 5/2011 | Klefenz et al. |
| 2012/0020485 | A1 | 1/2012 | Visser et al. |
| 2012/0051548 | A1 | 3/2012 | Visser et al. |
| 2012/0114126 | A1 | 5/2012 | Thiergart et al. |
| 2012/0140947 | A1 | 6/2012 | Shin |
| 2012/0221131 | A1 | 8/2012 | Wang et al. |
| 2013/0108066 | A1 | 5/2013 | Hyun et al. |
| 2013/0142343 | A1 | 6/2013 | Matsui et al. |
| 2013/0216047 | A1 | 8/2013 | Kuech et al. |
| 2013/0259243 | A1 | 10/2013 | Herre et al. |
| 2013/0268280 | A1 | 10/2013 | Del Galdo et al. |
| 2013/0272548 | A1 | 10/2013 | Visser et al. |
| 2013/0287225 | A1 | 10/2013 | Niwa et al. |
| 2014/0025374 | A1 | 1/2014 | Lou |
| 2014/0172435 | A1 | 6/2014 | Thiergart et al. |
| 2014/0376728 | A1 | 12/2014 | Ramo et al. |
| 2015/0310857 | A1 | 10/2015 | Habets et al. |

OTHER PUBLICATIONS

B. Loesch et al., "Multidimensional Localization of Multiple Sound Sources Using Frequency Domain ICA and an Extended State Coherence Transform," IEEE/SP 15th Workshop Statistical Signal Processing (SSP), pp. 677-680, Sep. 2009.

A. Lombard et al., "TDOA Estimation for Multiple Sound Sources in Noisy and Reverberant Environments Using Broadband Independent Component Analysis," IEEE Transactions on Audio, Speech, and Language Processing, pp. 1490-1503, vol. 19, No. 6, Aug. 2011.

H. Sawada et al., "Multiple Source Localization Using Independent Component Analysis," IEEE Antennas and Propagation Society International Symposium, pp. 81-84, vol. 48, Jul. 2005.

F. Nesta and M. Omologo, "Generalized State Coherence Transform for Multidimensional TDOA Estimation of Multiple Sources," IEEE Transactions on Audio, Speech, and Language Processing, pp. 246-260, vol. 20, No. 1, Jan. 2012.

M. Swartling et al., "Source Localization for Multiple Speech Sources Using Low Complexity Non-parametric Source Separation and Clustering," in Signal Processing, pp. 1781-1788, vol. 91, Issue 8, Aug. 2011.

C. Blandin et al., "Multi-Source TDOA Estimation in Reverberant Audio Using Angular Spectra and Clustering," in Signal Processing, vol. 92, No. 8, pp. 1950-1960, Aug. 2012.

D. Pavlidi et al., "Real-Time Multiple Sound Source Localization Using a Circular Microphone Array Based on Single-Source Confidence Measures," in International Conference on Acoustics, Speech and Signal Processing (ICASSP), pp. 2625-2628, Mar. 2012.

O. Yilmaz and S. Rickard, "Blind Separation of Speech Mixtures Via Time-Frequency Masking," IEEE Transactions on Audio, Speech, and Language Processing, pp. 1830-1847, vol. 52, No. 7, Jul. 2004.

E. Fishier et al., "Detection of Signals by Information Theoretic Criteria: General Asymptotic Performance Analysis," in IEEE Transactions on Signal Processing, pp. 1027-1036, vol. 50, No. 5, May 2002.

M. Puigt and Y. Deville, "A New Time-Frequency Correlation-Based Source Separation Method for Attenuated and Time Shifted Mixtures," in 8th International Workshop on Electronics, Control, Modelling, Measurement and Signals 2007 and Doctoral School (EDSYS, GEET), pp. 34-39, May 28-30, 2007.

G. Hamerly and C. Elkan, "Learning the k in k-means," in Neural Information Processing Systems, Cambridge, MA, USA: MIT Press, pp. 281-288, 2003.

B. Loesch and B. Yang, "Source Number Estimation and Clustering for Underdetermined Blind Source Separation," in Proceedings International Workshop Acoustic Echo Noise Control (IWAENC), 2008.

S. Araki et al., "Stereo Source Separation and Source Counting With MAP Estimation With Dirichlet Prior Considering Spatial Aliasing Problem," in Independent Component Analysis and Signal Separation, Lecture Notes in Computer Science. Berlin/Heidelberg, Germany: Springer, vol. 5441, pp. 742-750, 2009.

A. Karbasi and A. Sugiyama, "A New DOA Estimation Method Using a Circular Microphone Array," in Proceedings European Signal Processing Conference (EUSIPCO), 2007, pp. 778-782.

S. Mallat and Z. Zhang, "Matching Pursuit With Time-Frequency Dictionaries," IEEE Transactions on Signal Processing, vol. 41, No. 12, pp. 3397-3345, Dec. 1993.

D. Pavlidi et al., "Source Counting in Real-Time Sound Source Localization Using a Circular Microphone Array," in Proc. IEEE 7th Sensor Array Multichannel Signal Process Workshop (SAM), Jun. 2012, pp. 521-524.

A Griffin et al., "Real-Time Multiple Speaker DOA Estimation in a Circular Microphone Array Based on Matching Pursuit," in Proceedings 20th European Signal Processing Conference (EUSIPCO), Aug. 2012, pp. 2303-2307.

P. Comon and C. Jutten, Handbook of Blind Source Separation: Independent Component Analysis and Applications, ser. Academic Press. Burlington, MA: Elsevier, 2010.

M. Cobos et al., "On the Use of Small Microphone Arrays for Wave Field Synthesis Auralization," Proceedings of the 45th International Conference: Applications of Time-Frequency Processing in Audio Engineering Society Conference, Mar. 2012.

H. Hacihabiboglu and Z. Cvetkovic, "Panoramic Recording and Reproduction of Multichannel Audio Using a Circular Microphone Array," in Proceedings of the IEEE Workshop on Applications of Signal Processing to Audio and Acoustics (WASPAA 2009), pp. 117-120, Oct. 2009.

K. Niwa et al, "Encoding Large Array Signals Into a 3D Sound Field Representation for Selective Listening Point Audio Based on Blind Source Separation," in Proceedings of the IEEE International Conference on Acoustics, Speech and Signal Processing (ICASSP 2008), pp. 181-184, Apr. 2008.

V. Pulkki, "Spatial Sound Reproduction With Directional Audio Coding," Journal of the Audio Engineering Society, vol. 55, No. 6, pp. 503-516, Jun. 2007.

F. Kuech et al., "Directional Audio Coding Using Planar Microphone Arrays," in Proceedings of the Hands-free Speech Communication and Microphone Arrays (HSCMA), pp. 37-40, May 2008.

O. Thiergart et al., "Parametric Spatial Sound Processing Using Linear Microphone Arrays," in Proceedings of Microelectronic Systems, A. Heuberger, G. Elst, and R. Hanke, Eds., pp. 321-329, Springer, Berlin, Germany, 2011.

M. Kallinger et al., "Enhanced Direction Estimation Using Microphone Arrays for Directional Audio Coding," in Proceedings of the Hands-free Speech Communication and Microphone Arrays (HSCMA), pp. 45-48, May 2008.

M. Cobos et al., "A Sparsity-Based Approach to 3D Binaural Sound Synthesis Using Time-Frequency Array Processing," EURASIP Journal on Advances in Signal Processing, vol. 2010, Article ID 415840, 2010.

L. M. Kaplan et al., "Bearings-Only Target Localization for an Acoustical Unattended Ground Sensor Network," Proceedings of Society of Photo-Optical Instrumentation Engineers (SPIE), vol. 4393, pp. 40-51, 2001.

(56) References Cited

OTHER PUBLICATIONS

A. Bishop and P. Pathirana, "Localization of Emitters Via the Intersection of Bearing Lines: A Ghost Elimination Approach," IEEE Transactions on Vehicular Technology, vol. 56, No. 5, pp. 3106-3110, Sep. 2007.
A. Bishop and P. Pathirana, "A Discussion On Passive Location Discovery in Emitter Networks Using Angle-Only Measurements," International Conference on Wireless Communications and Mobile Computing (IWCMC), ACM, pp. 1337-1343, Jul. 2006.
J. Reed et al., "Multiple-Source Localization Using Line-of-Bearing Measurements: Approaches to the Data Association Problem," IEEE Military Communications Conference (MILCOM), pp. 1-7, Nov. 2008.
A. Alexandridis et al., "Directional Coding of Audio Using a Circular Microphone Array," IEEE International Conference on Acoustics, Speech and Signal Processing (ICASSP), pp. 296-300, May 2013.
A. Alexandridis et al., "Capturing and Reproducing Spatial Audio Based on a Circular Microphone Array," Journal of Electrical and Computer Engineering, vol. 2013, Article ID 718574, pp. 1-16, 2013.
M. Taseska and E. Habets, "Spotforming Using Distributed Microphone Arrays," IEEE Workshop on Applications of Signal Processing to Audio and Acoustics, Oct. 2013.
S. Rickard and O. Yilmaz, "On the Approximate W-Disjoint Orthogonality of Speech," in Proc. of ICASSP, 2002, vol. 1, pp. 529-532.
N. Ito et al., "Designing the Wiener Post-Filter for Diffuse Noise Suppression Using Imaginary Parts of Inter-Channel Cross-Spectra," in Proc. of ICASSP, 2010, pp. 2818-2821.
D. Pavlidi et al., "Real-Time Multiple Sound Source Localization and Counting Using a Circular Microphone Array," IEEE Trans. on Audio Speech, and Lang. Process, vol. 21, No. 10, pp. 2193-2206, 2013.
L. Parra and C. Alvino, "Geometric Source Separation: Merging Convolutive Source Separation With Geometric Beamforming," IEEE Transactions on Speech and Audio Processing, vol. 10, No. 6, pp. 352-362, 2002.
V. Pulkki, "Virtual Sound Source Positioning Using Vector Based Amplitude Panning," J. Audio Eng. Soc., vol. 45, No. 6, pp. 456-466, 1997.
J. Usher and J. Benesty, "Enhancement of Spatial Sound Quality: A New Reverberation-Extraction Audio Upmixer," IEEE Trans. on Audio Speech, and Lang. Process, vol. 15, No. 7, pp. 2141-2150, 2007.
C. Faller and F. Baumgarte, "Binaural Cue Coding—Part II: Schemes and Applications," IEEE Trans. on Speech and Audio Process, vol. 11, No. 6, pp. 520-531, 2003.
M. Briand, et al., "Parametric Representation of Multichannel Audio Based on Principal Component Analysis," in AES 120th Conv., 2008.
M. Goodwin and J. Jot., "Primary-Ambient Signal Decomposition and Vector-Based Localization for Spatial Audio Codding and Enhancement," in Proc. of ICASSP, 2007, vol. 1, pp. 1-9.
J. He et al., "A Study on the Frequency-Domain Primary-Ambient Extraction for Stereo Audio Signals," in Proc. of ICASSP, 2014, pp. 2892-2896.
J. He et al., "Linear Estimation Based Primary-Ambient Extraction for Stereo Audio Signals," IEEE Trans. on Audio, Speech and Lang. Process., vol. 22, pp. 505-517, 2014.
C. Avendano and J. Jot, "A Frequency Domain Approach to Multichannel Upmix," J. Audio Eng. Soc., vol. 52, No. 7/8, pp. 740-749, 2004.
O. Thiergart et al. "Diffuseness Estimation With High Temporal Resolution Via Spatial Coherence Between Virtual First-Order Microphones," in Applications of Signal Processing to Audio and Acoustics (WASPAA), 2011, pp. 217-220.
G. Carter et al, "Estimation of the Magnitude-Squared Coherence Function Via Overlapped Fast Fourier Transform Processing," IEEE Trans. on Audio and Electroacoustics, vol. 21, No. 4, pp. 337-344, 1973.
I. Santamaria and J. Via, "Estimation of the Magnitude Squared Coherence Spectrum Based on Reduced-Rank Canonical Coordinates," in Proc. of ICASSP, 2007, vol. 3, pp. III-985.
D. Ramirez, J. Via and I. Santamaria, "A Generalization of the Magnitude Squared Coherence Spectrum for More Than Two Signals: Definition, Properties and Estimation," in Proc. of ICASSP, 2008, pp. 3769-3772.
B. Cron and C. Sherman, "Spatial-Correlation Functions for Various Noise Models," J. Acoust. Soc. Amer., vol. 34, pp. 1732-1736, 1962.
H. Cox et al., "Robust Adaptive Beamforming," IEEE Trans. on Acoust., Speech and Signal Process., vol. 35, pp. 1365-1376, 1987.

DIRECTION OF ARRIVAL ESTIMATION AND SOUND SOURCE ENHANCEMENT IN THE PRESENCE OF A REFLECTIVE SURFACE APPARATUSES, METHODS, AND SYSTEMS

CROSS-REFERENCE TO RELATED APPLICATIONS

This application claims priority to U.S. Provisional Patent Application No. 62/232,284, filed Sep. 24, 2015. This application is also a continuation-in-part of U.S. patent application Ser. No. 15/183,538, filed Jun. 15, 2016; which in turn is a continuation of U.S. patent application Ser. No. 15/001,190, filed Jan. 19, 2016; which in turn is a continuation-in-part of U.S. patent application Ser. No. 14/556,038, filed Nov. 28, 2014 and now issued as U.S. Pat. No. 9,549,253 (claiming priority to U.S. Provisional Patent Application No. 61/909,882, filed Nov. 27, 2013); which is in turn a continuation-in-part of U.S. patent application Ser. No. 14/294,095, filed Jun. 2, 2014 and now issued as U.S. Pat. No. 9,955,277 (claiming priority to U.S. Provisional Patent Application No. 61/829,760 filed May 31, 2013); which is in turn a continuation-in-part of U.S. patent application Ser. No. 14/038,726 filed Sep. 26, 2013 and now issued as U.S. Pat. No. 9,554,203 (claiming priority to U.S. Provisional Patent Application No. 61/706,073 filed Sep. 26, 2012). Each of the applications listed in this paragraph are expressly incorporated by reference herein in their entirety.

FIELD

The present subject matter is directed generally to apparatuses, methods, and systems for acoustic signal processing, and more particularly, to DIRECTION OF ARRIVAL ESTIMATION AND SOUND SOURCE ENHANCEMENT IN THE PRESENCE OF A REFLECTIVE SURFACE APPARATUSES, METHODS, AND SYSTEMS (hereinafter "Reflector").

BACKGROUND

Direction of Arrival (DOA) estimation is an important topic in acoustic signal processing. Estimating the location of acoustic sources is important in many applications such as teleconferencing, camera steering, and spatial audio, to name a few. In the vast majority of known techniques for DOA estimation, the free-field assumption is required to hold, that is that there are no reflections introduced from the environment, or at least the direct sound from the source to the sensor array is dominant over the reverberant path.

But in real acoustic environments, a transmitted signal is often received via multiple paths due to reflection, diffraction, and scattering by objects in the transmission medium. This multipath effect can be understood as mirror-image sources which produce multiple wavefronts interfering with each other, a fact that unfavorably affects direct-path localization techniques. The image sources tend to widen the estimated Direction of Arrival (DOA) distributions around the true DOA, an effect that grows in proportion to the reverberation time of the acoustic environment.

DOA estimation and localization in reverberant rooms is still possible to some degree, if it can be assumed that the energy of the direct wavefronts predominates over the contributions of early reflections, reverberations, and noise. The performance can be improved to some extent by preselecting the signal portions that are less severely distorted with multipath signals and noise, as well as signal portions where one source is significantly more dominant than others. On the other hand, a propagation model may be employed that takes into account some of the early reflections introduced by the acoustic environment. It has been shown that single reflections may convey additional information which can be exploited to not only make sound-source localization possible in reverberant rooms, but also to extract additional important spatial information regarding the sound sources. For example, the additional information may be exploited to make range and elevation estimates, something that would not be possible with a sensor array under free-field conditions.

Early reflections may have an adverse effect on the performance of several applications related to microphone-array signal processing. For example, when a microphone array is close to one of the walls of a room, the reflection introduced by that wall may significantly degrade the performance of a DOA estimation. Yet as a practical matter, placing a microphone array far away from the walls in a room may be difficult or impossible.

SUMMARY

A processor-implemented method for sound-source enhancement in the presence of a reflective surface is disclosed. The method includes: capturing a signal from a sound source using a sensor array having a plurality of sensors, the sensor array being positioned between the sound source and the reflective surface; calculating a half-space propagation model by determining a modified steering vector associated with a plane sound wave produced by the sound source as a function of signal direction and the reflectivity value; calculating a half-space spatial coherence model by dividing a sphere with its center on the reflecting surface into two mirror symmetric parts intersected by a plane to create two half spheres and accounting for a finite number of uniformly distributed plane wave sources originating from the surface of the half sphere which includes the sensor array by considering a uniform distribution of plane wave sources on the half sphere and letting the signature of each plane wave be expressed by the half-space propagation model; creating a half-space signal-enhancement module using the half-space propagation model and the half-space coherence model; and applying the half-space signal-enhancement module to the signal to enhance the signal.

A system for sound-source enhancement in the presence of a reflective surface is also disclosed. The system includes: a sensor array having a plurality of sensors, the sensor array being positioned between a sound source and the reflective surface at a predetermined distance from the reflective surface, and a half-space signal enhancer. The half-space signal enhancer is configured to: calculate a half-space propagation model by determining a modified steering vector associated with a plane sound wave produced by the sound source as a function of signal direction and the reflectivity value; calculate half-space spatial coherence model by dividing a sphere with its center on the reflecting surface into two mirror symmetric parts intersected by a plane to create two half spheres and accounting for a finite number of uniformly distributed plane wave sources originating from the surface of the half sphere which includes the sensor array by considering a uniform distribution of plane wave sources on the half sphere and letting the signature of each plane wave be expressed by the half-space propagation model; and enhance the signal based on the half-space propagation model and the half-space coherence model.

A processor-readable tangible medium for sound-source enhancement in the presence of a reflective surface is also disclosed. The medium stores processor-issuable-and-generated instructions to: capture a signal from a sound source using a sensor array having a plurality of sensors, the sensor array being positioned between the sound source and the reflective surface; calculate a half-space propagation model by determining a modified steering vector associated with a plane sound wave produced by the sound source as a function of signal direction and the reflectivity value; calculate a half-space spatial coherence model by dividing a sphere with its center on the reflecting surface into two mirror symmetric parts intersected by a plane to create two half spheres and accounting for a finite number of uniformly distributed plane wave sources originating from the surface of the half sphere which includes the sensor array by considering a uniform distribution of plane wave sources on the half sphere and letting the signature of each plane wave be expressed by the half-space propagation model; create a half-space signal-enhancement module using the half-space propagation model and the half-space coherence model; and apply the half-space signal-enhancement module to the signal to enhance the signal.

BRIEF DESCRIPTION OF THE DRAWINGS

The accompanying drawings illustrate various non-limiting, example, inventive aspects of the Reflector.

DETAILED DESCRIPTION

Reflector

DIRECTION OF ARRIVAL ESTIMATION AND SOUND SOURCE ENHANCEMENT IN THE PRESENCE OF A REFLECTIVE SURFACE APPARATUSES, METHODS, AND SYSTEMS (hereinafter "Reflector") are disclosed in this specification, which describes a novel approach to signal processing that compensates for the reflection introduced by a wall adjacent to a sound-capturing device such as a microphone array. This novel approach can lead to a significant increase in the performance of a sound-source enhancement system that is required to operate in a small enclosure. The systems and methods disclosed enables a sensor array to produce accurate DOA estimations by compensating for the most dominant reflections which are introduced by a plane surface, such as the wall of a room.

In one exemplary embodiment, the case of a coincident microphone array placed just in front of a wall of the room is considered. The microphone array may be placed so that the vector normal to the surface of the wall has a zero elevation angle with respect to the way that azimuth and elevation angle are defined. This is a modification to the propagation model, which accounts for the direct path only, by incorporating also the contribution of the earliest reflection introduced by the adjacent vertical wall. Based on this so called half-space propagation model, the Reflector may numerically calculate a spatial coherence model. This half-space spatial coherence model is inherently different from other well known types of spatial coherence models, and is better suited to a wall-array arrangement, to give one example, and also leads to substantial improvements in the performance of classical array signal processing applications, such as superdirective beamforming.

Figure 1:
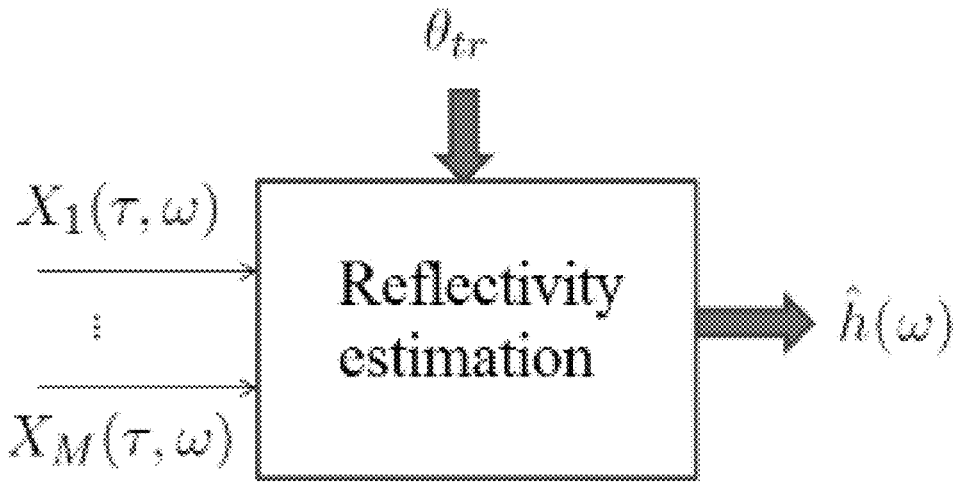
FIG. 1 is a block diagram showing reflectivity estimation in one exemplary embodiment of the Reflector.

In one exemplary embodiment, the Reflector uses both a propagation model and a spatial-coherence model that are specific to the wall-array arrangement and can be estimated as a function of the frequency based on the microphone array geometry, the placement of the array with respect to the wall, and the wall reflectivity. In one exemplary embodiment, the two models can be estimated at each frequency based on an estimation of the wall reflectivity. For example, the wall reflectivity may be assumed to have a real value and to be constant with frequency. In another embodiment, the wall reflectivity is assumed to be a complex value and varying with frequency, and can be estimated at each frequency based on a reflectivity estimation process illustrated in FIG. 1.

Figure 2:
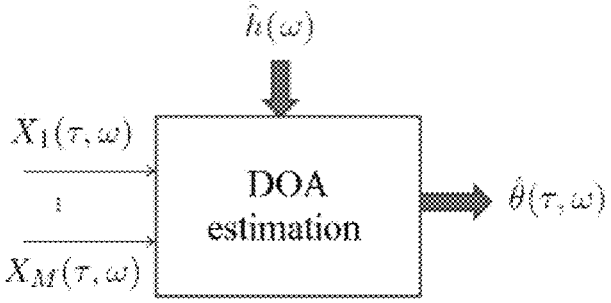
FIG. 2 is block diagram showing Direction of Arrival (DOA) estimation in one exemplary embodiment of the Reflector.
Figure 3:
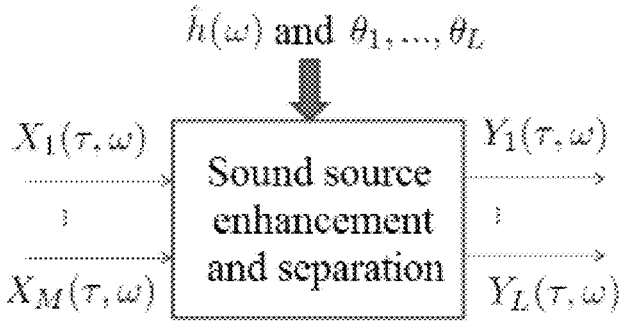
FIG. 3 is a block diagram showing sound source enhancement and separation in one exemplary embodiment of the Reflector.

In one exemplary embodiment, the Reflector can be configured to build a sound source enhancement system that operates in two steps. In the first step, the half-space propagation model is used to construct a direction of arrival (DOA) estimation system, as shown in FIG. 2, which may be used to estimate the location of one or more active sound sources, such as speakers, inside a room. In the second step, based on the estimated directions found in the first step, the Reflector may then apply a half-space signal enhancement module, such as a half-space superdirective (HFSD) beamformer in combination with a post filter for enhancing and separating the sound sources, as illustrated in FIG. 3, provided that the sound sources are located at different directions with respect to the microphone array.

This embodiment of an HFSD beamformer is different from the classical superdirective beamformers in the sense that it utilizes the previously mentioned half-space propagation model (rather than the conventional propagation model), and it utilizes the previously mentioned half-space coherence model (rather than the conventional spatial coherence model). It should be noted that the beamformers described in this specification are exemplary. The Reflector may use any other suitable beamformer or steering-vector-based methods and apparatuses for direction of arrival (DOA) estimation and/or signal enhancement.

Throughout this specification, superscripts *, T and H, denote complex conjugation, transposition and Hermitian transposition respectively, while $\Im[\bullet]$ and $\Re[\bullet]$ denote the imaginary and real part of a complex number respectively. Signals are represented in the Time-Frequency (TF) domain with $\omega\in\mathbb{R}$ and $\tau\in\mathbb{Z}$ denoting the angular frequency and the time-frame index respectively.

In one exemplary embodiment, the short-term Fourier transforms (STFTs) of the observed signals and the lth source signal are denoted by $x(\tau, \omega)=[X_1(\tau, \omega), \ldots, X_M(\tau, \omega)]^T$ and $S_l(\tau, \omega)$, $l=1, \ldots, L$. With these notations, the observation signal can be modeled as $$x(\tau, \omega) = \sum_{l=1}^{L} a(\omega, \theta_l, \psi_l) S_l(\tau, \omega) + u(\tau, \omega) \tag{1}$$

where $a(\omega, \theta_l, \psi_l)=[a_1(\omega, \theta_l, \psi_l), \ldots, a_M(\omega, \theta_l, \psi_l)]^T$ is a steering vector (or propagation model) associated with the lth source at azimuth angle $\theta_l$ and elevation angle $\psi_l$ and $u(\tau, \omega)=[z_1(\tau, \omega), \ldots, z_M(\tau, \omega)]^T$ models additive noise and the reverberant part of the signal which is not included in a.

Typically, the steering vector describes the transfer function characterizing a plane sound wave impinging on the array from azimuth angle θ and elevation ψ relevant to some reference point O. The reference point O may coincide or not coincide with a particular microphone location. For example, in the case of a circular microphone array, the reference point coincides with the center of the circular disk.

In the general case, for any given type of array of M microphones, one may define a function $a(\omega, \theta, \psi)$ in $\mathbb{C}^M$ which describes the transfer function characteristics of the plane wave relevant to the reference point O. As in the case of the circular array, this function can be an analytic function of θ, ψ and ω (a detailed example for the case of a circular array is given below). On the other hand, this function may be provided as the output of an algorithm which receives as input variables associated to the geometry of the microphone array, the frequency of interest and the direction of the impinging plane wave. This design choice, which ignores any acoustic paths other than the direct path, can be referred to as the anechoic or classical propagation model.

This is the typical case in the majority of propagation models associated with coincident microphone arrays. The propagation model typically accounts for the direct path of the sound only and ignores any distinct reflections that may occur due to the listening environment. Estimating all the secondary paths is difficult in practice, as it would require detailed knowledge of the room geometry, or a cumbersome measurement procedure. Assuming however that the distance of the microphone array from a particular wall is much smaller in comparison to the distance of the array from the other walls, it can be expected that the earliest reflection carries a relatively large portion of the energy of the reverberant part of the signal. Moreover, assuming far field conditions and a perfect specular reflection, the Reflector may determine this component deterministically, by considering an array of known orientation and distance from the closest wall.

Figure 4:
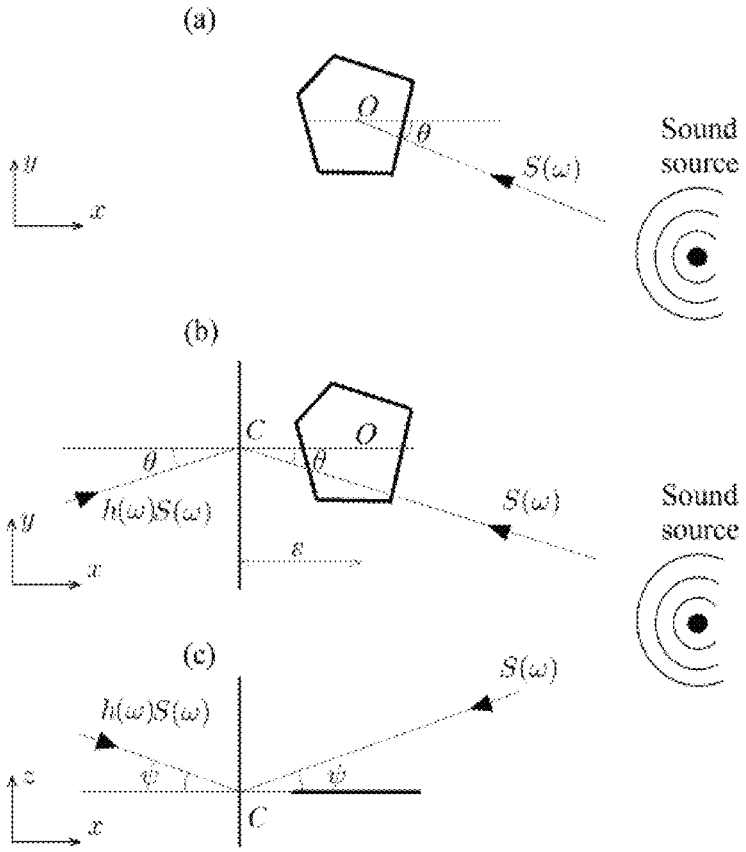
FIG. 4 is a graphical representation showing a plane wave of strength $S(\omega)$ impinging on a planar array with azimuth angle $\theta$ and elevation $\psi$. In the typical approach, shown in (a), $\theta$ and $\psi$ are defined with respect to the microphone array center denoted with O. In the half-space case, $\theta$ and $\psi$ are defined with respect to the projection of O on the reflective boundary, denoted with C in (b) and (c). A reflected version of the same wave with amplitude $h(\omega)S(\omega)$ is superimposed in the case of the half-space model in (b) and (c).

In FIG. 4, the novel half-space geometric model disclosed in this specification is shown at (b) and (c), as opposed to the classical geometric model shown (a), for the case of a planar microphone array of M microphones and arbitrary shape, placed close to a reflecting plane with a normal vector parallel to the x-axis. In one embodiment, the Reflector considers that a plane wave of strength $S(\omega)$ propagates towards the microphone array with an azimuth angle θ and an elevation angle ψ. The impinging wave will generate a reflected component of strength $h(\omega)S(\omega)$, arriving from angle $\theta'=\pi-\theta$. The quantity $h(\omega)\in\mathbb{C}$ is called the Image Source Relative Gain (ISRG) and expresses the relative gain with which the image source contributes to the sound field. In the general case, $h(\omega)$ is complex and varies with frequency. However, in one exemplary embodiment, the Reflector may assume that ISRG is a real number and constant with frequency so that $h(\omega)$=const with const denoting a real positive constant. Intuitively, a value of ISRG close to 1 would correspond to a rigid surface, implying that the energy of the incident wave is equal to the energy of the reflected wave.

Given the anechoic steering vector $a(\omega, \theta, \psi)$ and the distance E of reference point O from the reflecting plane, the Reflector may then construct a new steering vector $\tilde{a}(\omega, \theta, \psi)$ as $$\tilde{a}(\omega,\theta,\psi)=a(\omega,\theta,\psi)e^{jk\in\cos\theta\cos\psi}+h(\omega)a(\omega,\pi-\theta,\psi)e^{-jk\in\cos\theta\cos\psi}, \tag{2}$$

and then reach to the final version of the half-space steering vector, $a'(\omega, \theta, \psi)$, by normalizing at each azimuth and elevation point as $$a'(\omega,\theta,\psi)=\tilde{a}(\omega,\theta,\psi)/\|\tilde{a}(\omega,\theta,\psi)\|_2, \tag{3}$$

where $\|\bullet\|_2$ denotes the Euclidean norm. Equation (2) above defines an exemplary embodiment of the half-space propagation model, which better describes the transfer function characteristics for the particular wall-array arrangement. When the problem is confined to two dimensions, the elevation angle ψ can be ignored. In this case, Equation (2) may be rewritten as $$\tilde{a}(\omega,\theta)=a(\omega,\theta)e^{jk\in\cos\theta}+h(\omega)a(\omega,\pi-\theta)e^{-jk\in\cos\theta}, \tag{4}$$

where the Reflector again reaches the final version of the half-space steering vector through a normalization step: $a'(\omega, \theta)=\tilde{a}(\omega, \theta)/\|\tilde{a}(\omega, \theta)\|_2$ with $\|\bullet\|_2$ denoting the Euclidean norm.

With respect to the geometric model shown in (b) and (c) of FIG. 4, in one exemplary embodiment, the incident angle θ may be defined with respect to the projection of the array center on the reflective plane (point C) rather than with respect to the array center itself (point O), which is the case for the anechoic propagation model. This design implies that the incident angle seen from the acoustic center C and from the sensor array is the same and equal to θ, which requires the so called far field condition to hold, e.g. that $r \gg R$ and $r \gg \epsilon$, with r denoting the distance of the sound source from the acoustic center C.

Figure 5:
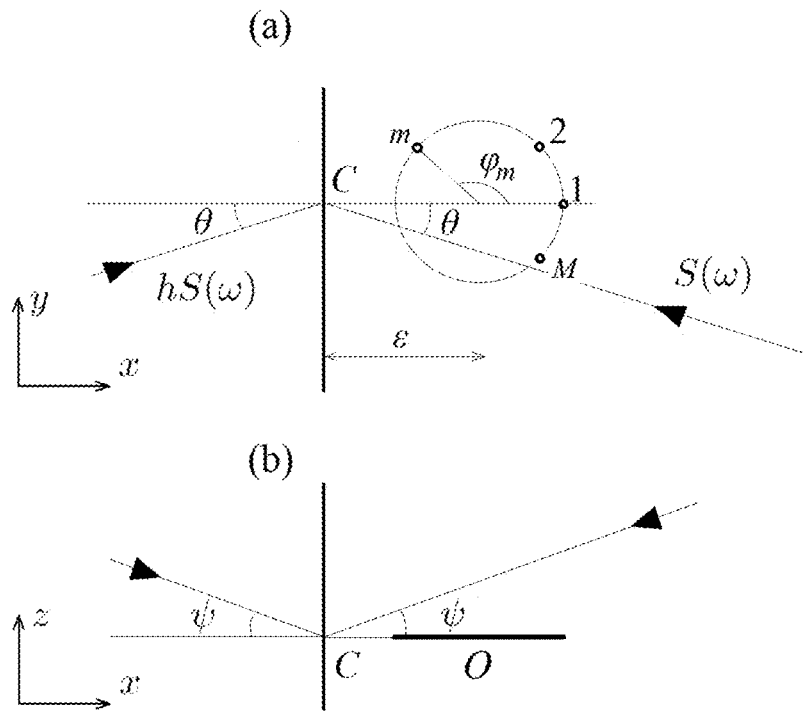
FIG. 5 is a graphical representation of a plane wave of strength $S(\omega)$ impinging on a circular array of M sensors with azimuth angle $\theta$ and elevation $\psi$.

In one exemplary embodiment, the Reflector may include an array that is a uniform circular array of M sensors with its center O placed at a distance E from the reflecting wall, as depicted in FIG. 5. For a circular horizontal array of M sensors and radius R, the conventional anechoic steering vector can be written as $a(\omega, \theta, \psi)=[a_1(\omega, \theta, \psi), \ldots, a_M(\omega, \theta, \psi)]^T$ with $$a_m(\omega,\theta)=e^{jkR\cos(\phi_m-\theta)\cos(\psi)} \tag{5}$$

where $k=\omega/c$ denotes the wave number and $\phi_m$ is the angle of the mth microphone defined with respect to the center of the circle.

For the half-space model, the Reflector may modify the steering vector above by first constructing the new vector $\acute{a}(\omega, \theta, \psi)=[\tilde{a}_1(\omega, \theta, \psi), \ldots, \tilde{a}_M(\omega, \theta, \psi)]^T$ with its mth component defined as $$\tilde{a}_m(\omega,\theta,\psi)=e^{jkR\cos(\phi_m-\theta)\cos\psi}e^{jk\in\cos\theta\cos\psi}+h(\omega)e^{jkR\cos(\phi^m-\pi+\theta)\cos\psi}e^{-jk\in\cos\theta\cos\psi}. \tag{6}$$

and then normalizing $\acute{a}_m(\omega, \theta, \psi)$ at each azimuth and elevation point to reach to the final half-space model as $$a'(\omega,\theta,\psi)=\tilde{a}(\omega,\theta,\psi)/\|\tilde{a}(\omega,\theta,\psi)\|_2, \tag{7}$$

where $\|\bullet\|_2$ denotes the Euclidean norm. A variant of this propagation model which accounts for a zero elevation angle $\psi=0$ can also be constructed by setting $$\tilde{a}_m(\omega,\theta)=e^{jkR\cos(\phi_m-\theta)}e^{jk\in\cos\theta}+h(\omega)e^{jkR\cos(\phi_m-\pi+\theta)}e^{-jk\in\cos\theta}, \tag{8}$$

and then normalizing $\tilde{a}_m(\omega, \theta)$ at each azimuth location as in Equation 7.

The spherical isotropic model is a widely used model as it has been shown that it reflects the statistics of the reverberant part of the signals in a given room. The spatial coherence for the case of spherical isotropic noise can be calculated analytically by taking the integral over all plane waves that originate from the surface of a sphere. Moreover, the same principle can be exploited for simulating sensor signals in spherical isotropic noise. The isotropic assumption implies that the power spectrum densities of the signals are independent of the location. Also, in a spherical isotropic sound field, the cross-power spectrum between two omnidirectional sensors does not depend on the spatial coordinates of the two sensors, but only on their pairwise distance $d_{ij}$ so that $$Q_{ij}(\omega)=\frac{\sin kd_{ij}}{kd_{ij}}. \tag{9}$$

where as before, $k=\omega/c$ is the wavenumber and $Q_{ij}$ is the element at the ith row and jth column of the M×M spatial coherence matrix Q.

This isotropic assumption is not a valid assumption in the half-space problem. For example, as the microphone approaches the boundary, a gradual increment of the sound pressure is expected, which implies that the power spectral densities of the signals are dependent on the x-coordinates. Certainly, this means that designing a spatial coherence matrix based on the isotropic assumption is not expected to reflect the actual signal statistics in the half-space problem. Borrowing however from the same geometrical representation, it can be demonstrated that a near-optimal spatial coherence matrix can be calculated, in a numerical manner, as follows: the Reflector considers a sphere which has its center on the reflecting plane and which, when intersected by that plane, is divided into two mirror-symmetric parts. The Reflector then accounts for a finite number of uniformly distributed plane wave sources originating from the surface of the half-sphere which includes the sensor array. In particular, the Reflector considers a uniform distribution of plane wave sources on the half sphere $\theta\in(-\pi/2, \pi/2)$ and $\psi\in(-\pi/2, \pi/2)$ rather on the full sphere (in which case $\theta\in(-\pi, \pi)$). Also, the Reflector allows the signature of each plane wave to be expressed by the half-space propagation model of Eq. (2).

Based on the above, the half-space spatial coherence matrix may be approximated by the Reflector as $$Q^{(h)}(\omega)=\sum_{j=1}^{J}a^H(\omega,\theta_j,\psi_l)a(\omega,\theta_j,\psi_j)^H, \tag{10}$$

where a=a' is the half-space propagation model defined in Eq. (2) and $(\theta_j, \psi_j)$ are the azimuth and elevation angles of J plane wave sources uniformly distributed on the half sphere $\theta_j\in(-\pi/2, \pi/2)$ and $\phi_j\in(-\pi/2, \pi/2)$ for each j. Achieving a uniform distribution on the half-sphere can be accomplished in many different ways and one of the most common one is to use the spiral equation. We then normalize $Q_h$ at each frequency to derive the final version of the half-space spatial covariance matrix as $$\hat{Q}^{(h)}(\omega)=\frac{Q^{(h)}(\omega)}{\|Q^{(h)}(\omega)\|_{max}}, \tag{11}$$

where $\|\mathbf{A}\|_{max}=\max\{|a_{mn}|\}$, i.e. the absolute value of the largest element in a matrix. The half-space spatial coherence matrix as described can be used in many different applications related to microphone array signal processing, for example, to design superdirective beamformers with improved signal enhancement performance.

Figure 6:
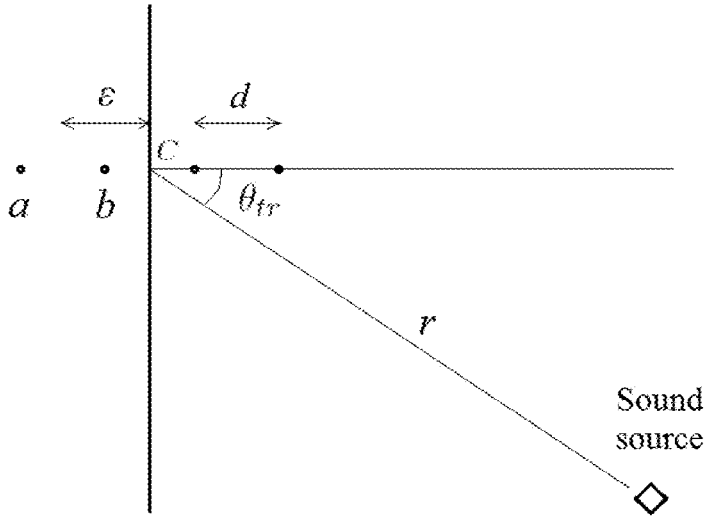
FIG. 6 is a graphical representation showing two microphones placed near a wall so that the line segment that connects the two microphone centers is perpendicular to the plane of the reflective boundary.

An exemplary method for estimating the reflectivity or mirror source relative gain (MSRG) $h(\omega)$, as used by the Reflector, is presented. In one exemplary embodiment, the method is applicable as long as there are at least two microphones placed close to the wall so that the line segment that connects the two microphone centers is perpendicular to the plane of the reflective boundary, as shown in FIG. 6. This condition can be easily fulfilled with classical planar microphone arrays such as a circular microphone array, although many other configurations may be used with the Reflector.

Assuming that the surface is locally reacting and that there is specular reflection, the model of the sound pressure at the sensors can be approximated as the superposition of the direct sound and the reflected sound. The reflected component can be calculated by accounting for the propagation path from the "mirror source" to the actual sensors, or equivalently, by accounting for the propagation path from the actual source to the "mirror sensors". In one exemplary embodiment, the Reflector assumes that the planar array has two microphones $\alpha$ and $\beta$, at distance d from one another and that their locations fulfill the previously mentioned requirement that the line segment that connects the two microphone centers form a line perpendicular to the wall of interest.

In one exemplary embodiment, where $X_\alpha(\omega, \tau)$ and $X_\beta(\omega, \tau)$ denote the sound signal at the two microphones at each TF point, the Reflector may assume that there is a single broadband sound source at a known azimuth angle $\theta$ with respect to the acoustic center C and at distance r in meters (assuming that elevation angle is $\psi=0$ for that source). The Reflector may then define a model of the sound pressure at the sensors as a function of the angle of the single sound source θ as $$X_\alpha(\omega,\tau)=S(\omega,\tau(e^{-jk(r+(-\epsilon-d/2)\cos\theta)}+h(\omega)e^{-jk(r+(\epsilon+d/2)\cos\theta)})) \quad (12)$$

for sensor indexed by α and $$X_\beta(\omega,\tau)=S(\omega,\tau)(e^{-jk(r+(-\epsilon+d/2)\cos\theta)}+h(\omega)e^{-jk(r+(\epsilon-d/2)\cos\theta)})) \quad (13)$$

for sensor indexed by β.

In what follows, the frequency and time index are omitted for convenience. A model of the sensor auto-spectra and inter-channel cross-spectra terms can then be derived. This model would be observed at frequency ω for a sound source at angle θ and for a MSRG equal to h which is considered to be constant with respect to the incidence angle θ (but of course varies with frequency ω). In this exemplary embodiment, the auto-spectra at sensor a is $$\Phi_{\alpha,\alpha}=\Phi_{ss}+h\Phi_{ss}e^{-jk(2\epsilon+d)\cos\theta}+h^*\Phi_{ss}e^{jk(2\epsilon+d)\cos\theta}+|h|^2\Phi_{ss}, \quad (14)$$

while for sensor b it can be written as $$\Phi_{\beta,\beta}=\Phi_{ss}+h\Phi_{ss}e^{-jk(2\epsilon-d)\cos\theta}+h^*\Phi_{ss}e^{jk(2\epsilon-d)\cos\theta}+|h|^2\Phi_{ss}, \quad (15)$$

where $\Phi_{ss}=\Phi_{ss}(\omega,\tau)=E\{S(\omega,\tau)S(\omega,\tau)^*\}$ is the signal power spectrum.

The inter-channel cross-spectra can also be constructed as $$\Phi_{\alpha,\beta}=\Phi_{ss}e^{jkd\cos\theta}+h\Phi_{ss}e^{-2jk\epsilon\cos\theta}+h^*\Phi_{ss}e^{2jk\epsilon\cos\theta}+|h|^2\Phi_{ss}e^{-jkd\cos\theta}. \quad (16)$$

The Reflector may use the second order statistics above to estimate the unknown MSRG h(ω) across a continuous range of frequency points $0<\omega\leq\omega_{max}$, where $\omega_{max}$ is the upper frequency limit introduced by practical constraints such as spatial aliasing. The basic requirement here is that the angle where the sound source is located, the so called training angle $\theta_{tr}$ is known. The starting point for retrieving h is to observe that the Reflector may exploit the empirically measured auto- and cross-spectra terms to derive an estimation of the quantities $\hat{\Phi}_{\alpha,\beta}-\hat{\Phi}_{\alpha,\alpha}e^{-jkd\cos\theta}$ and $\hat{\Phi}_{\beta,\alpha}-\hat{\Phi}_{\beta,\beta}e^{jkd\cos\theta}$. Given $\theta_{tr}$, these two quantities relate to the model through $$\Phi_{\alpha,\beta}-\Phi_{\alpha,\alpha}e^{-jkd\cos\theta_{tr}}\leftarrow 2j\Phi_{ss}\sin(kd\cos\theta_{tr})+h\Phi_{ss}(e^{-2jk\epsilon\cos\theta_{tr}}-e^{-2jk(\epsilon+d)\cos\theta_{tr}}) \quad (17)$$

and $$\hat{\Phi}_{\beta,\alpha}-\hat{\Phi}_{\beta,\beta}e^{jkd\cos\theta_{tr}}\leftarrow -2j\Phi_{ss}\sin(kd\cos\theta_{tr})+h\Phi_{ss}(e^{-2jk\epsilon\cos\theta_{tr}}-e^{-2jk(\epsilon-d)\cos\theta_{tr}}) \quad (18)$$

Dividing Eq. (17) with Eq. (18), we define the auxiliary quantity $$\rho(\tau,\omega)=\frac{\hat{\Phi}_{\alpha,\beta}(\tau,\omega)-\hat{\Phi}_{\alpha,\alpha}(\tau,\omega)e^{-jkd\cos\theta_{tr}}}{\hat{\Phi}_{\beta,\alpha}(\tau,\omega)-\hat{\Phi}_{\beta,\beta}(\tau,\omega)e^{jkd\cos\theta_{tr}}}, \quad (19)$$

which is independent from the source power spectrum $\Phi_{ss}(\tau,\omega)$. The MSRG can now be solved in terms of the auxiliary quantity ρ(τ, ω) at each time-frequency point as $$\hat{h}(\tau,\omega)=\frac{-2k(1+\rho(\tau,\omega))\sin(kd\cos\theta)}{e^{-2jk\epsilon\cos\theta_{tr}}(1-\rho(\tau,\omega)-e^{-2jkd\cos\theta_{tr}}+\rho(\tau,\omega)e^{2jkd\cos\theta_{tr}})}. \quad (20)$$

where $\hat{h}(\tau,\omega)$ denotes an estimation of h(ω) at time-frame τ. The values of $\hat{h}(\tau,\omega)$ are then stored in a collection of local MSRGs at each frequency point as $$H(\omega)\leftarrow H(\omega)\cup\hat{h}_{\tau,\omega}. \quad (21)$$

Having a large collection of estimated MSRGs, we expect that the estimated values will cluster around the actual MSRGs value h(ω). The Reflector then forms a histogram with respect to the real part and the imaginary part in order to derive a final estimation of the complex MSRG as $$\tilde{h}(\omega)=\hat{h}_{Re}(\omega)+i\hat{h}_{Im}(\omega), \quad (22)$$

where $\hat{h}_{Re}(\omega)$ and $\hat{h}_{Im}(\omega)$ correspond to the values of the histogram with the highest cardinality, referring to the real part and imaginary part respectively.

The advantage of the method is that it allows the in-situ estimation of the acoustic properties of the reflective plane, without the need for a known reference signal. It thus eliminates the need for loudspeakers to excite the acoustic environment. In this exemplary embodiment, the MSRG estimation can be performed with a speech signal, provided that the direction $\theta_{tr}$ of the speaker is known and given to the system. As long as the MSRG is estimated, any other acoustic property of the reflective plane, such as the absorption/reflection coefficient and the acoustic impedance can also be estimated.

In one exemplary embodiment, the Reflector is able to perform a DOA estimation in the half-space. For example, the Reflector may assume the presence of L simultaneous sound sources at locations $(\theta_l, \psi_l)$, l=1, . . . , L, where $\theta_l$ and $\psi_l$ denote the azimuth and elevation angle of the lth source.

Given a valid steering vector which is defined as a function of the incident angle, different approaches can be designed for DOA estimation. For example, in one approach, a DOA estimation is performed by steering a Matched Filter (MF) or a Minimum Variance Distortionless Response (MVDR) beamformer across a grid of potential source locations in 2D or 3D. The grid point for which the power output of the beamformer is maximized may be considered the most probable source location for the particular time-frequency point of analysis. The process can be illustrated in terms of the so-called angular spectrum of the MF beamformer, defined at each time-frequency (TF) point as $$P_{MF}(\tau,\omega,i)=\frac{a^H(\omega,\theta_i,\psi_i)\hat{R}(\tau,\omega)a(\omega,i)}{a^H(\omega,\theta_i,\psi_i)a(\omega,\theta_i,\psi_i)} \quad (23)$$

and of the MVDR beamformer defined as $$P_{MVDR}(\tau,\omega,i)=\frac{1}{a^H(\omega,\theta_i,\psi_i)\hat{R}^{-1}(\tau,\omega)a(\omega,\theta_i,\psi_i)}. \quad (24)$$

where i=1, . . . , I are the indexes of the I grid points, $\hat{R}(\tau,\omega)$ is the time-averaged empirical covariance matrix and vector $a(\omega,\theta_i,\psi_i)$ is the steering vector for incoming azimuth angle $\theta_i$ and elevation angle $\psi_i$.

To address the case of the half-space problem, DOA estimation should be performed by setting the steering vector equal to a' as in Equation 3. In one exemplary embodiment, the signal covariance matrix can be obtained at each time-frequency (TF) point using the following recursive formula $$\hat{R}(\tau,\omega)=(1-q)\hat{R}(\tau-1,\omega)+qx(\tau,\omega)x(\tau,\omega)^H \tag{25}$$

where $0 \le q \le 1$.

In another example, the Reflector may perform a DOA estimation by steering a superdirective beamformer across a grid of potential source locations in 3D. Using the superdirective (SD) technique, the angular spectrum is in this case defined as $$P_{SD}(\tau, \omega, i) = \frac{1}{a^H(\omega, \theta_i, \psi_i)\hat{Q}^{-1}(\omega)a(\omega, \theta_i, \psi_i)}. \tag{26}$$

where $\hat{Q}(\omega)$ is the half-space spatial coherence model of Eq. (11) and a is set equal to a' in Eq. (3).

At TF point $(\tau, \omega)$ the most likely source location is found by looking for the grid point with the maximum beamformer power output as $$\hat{i}_{\tau,\omega}=\text{argmax}_i P(\tau,\omega,i), \tag{27}$$

where P(•) is defined as in Eq. (23) or as in Eq. (24) and the azimuth and elevation angle corresponding to grid point $\hat{i}$, $\theta_i$ and $\psi_i$; are automatically returned as a function of the index of the grid point $\hat{i}$. The estimated azimuth and elevation angle $\theta_i$ and $\psi_i$ which are particular to TF point $(\tau, \omega)$ represent the finest granularity DOA information which is required for deriving a reliable estimation of the source locations. Several such estimations derived across multiple TF points are accumulated and jointly processed in order to infer $(\theta_l, \psi_l)$, $l=1, \ldots L$. Although many different approaches can be used for this task, an exact methodology for the case of a 2D problem is shown below, in which case, only one azimuth angle for each source needs to be estimated.

In the case that the problem is confined in 2D, the power output responses can be rewritten for the case of the matched filter (MF) beamformer as $$P_{MF}(\tau, \omega, \theta) = \frac{a^H(\omega, \theta)\hat{R}(\tau, \omega)a(\omega, \theta)}{a^H(\omega, \theta)a(\omega, \theta)}. \tag{28}$$

and for the case of the minimum variance distortionless response (MVDR) beamformer as $$P_{MVDR}(\tau, \omega, \theta) = \frac{1}{a^H(\omega, \theta)\hat{R}^{-1}(\tau, \omega)a(\omega, \theta)}. \tag{29}$$

In another example, the Reflector may perform a DOA estimation by steering a superdirective beamformer across a grid of potential source locations in 2D. Using the superdirective (SD) technique, the angular spectrum is in this case defined as $$P_{SD}(\tau, \omega, \theta) = \frac{1}{a^H(\omega, \theta)\hat{Q}^{-1}(\omega)a(\omega, \theta)}. \tag{30}$$

where $\hat{Q}(\omega)$ is the half-space spatial coherence model of Eq. (11) and a is set equal to a' in Eq. (3).

In one exemplary embodiment, the Reflector may perform DOA estimation in the half-space, using a planar microphone array placed just in front of one of the walls of a room, so that the plane of the microphone array is perpendicular to the plane of the wall, as shown in FIG. 4.

In one exemplary embodiment, for DOA estimation the Reflector follows the assumption of one predominant source per time-frequency point, which is valid for signals with a sparse time-frequency representation such as speech, at least until low reverberant conditions. The process may consist of using a grid search to find the most energetic DOA at each time-frequency point, processing the collection of DOAs across time in order to form a histogram and then localizing the most prominent peaks in the histogram. For each combination of steering vector and beamformer, one local DOA at each time-frequency point can be estimated by searching over a grid of I possible azimuth angles as $$\tilde{\theta}(\tau,\omega)=\text{argmax}_\theta P(\tau,\omega,\theta), \tag{31}$$

where the azimuth angle θ, in degrees, varies uniformly in the range [−180°, 180°) and ω is considered along all short-term Fourier transform (STFT) bins in the range $\omega_{LB} \le \omega \le \omega_{UB}$, where $\omega_{LB}$ and $\omega_{UB}$ correspond to a lower- and upper-frequency limit respectively. Considering the constraints imposed by the physical boundary, it is impossible to have a source at (90, 180) or at [−180, −90) and although angular locations in this range are scanned in Eq. (31), a particular time-frequency point is assigned a DOA (or not) according to the rule $$\hat{\theta}(\tau, \omega) = \begin{cases} \tilde{\theta}(\tau, \omega), & \text{if } -90° + \delta\theta < \tilde{\theta}(\tau, \omega) < 90° - \delta\theta \\ \emptyset, & \text{otherwise} \end{cases} \tag{32}$$

where $\emptyset$ denotes the empty set and δθ is a user defined threshold in degrees. The angle $\hat{\theta}(\tau, \omega)$ is then stored together with all other estimations in the collection $$\Theta(\tau)=\cup_{\omega=\omega_{LB}}^{\omega_{UB}}\hat{\theta}(\tau,\omega). \tag{33}$$

The Reflector can then find the direction of the sources by localizing the peaks in the histogram which is formed with the estimated DOAs in $\Theta(\tau)$. This may extend not only across many frequency bins, as Eq. (33) implies, but also across multiple time frames. In this case, the DOA estimation is derived from a set of estimates in a block of B consecutive time-frames $$C(\tau)=\cup_{t=\tau-B}^{\tau}\Theta(t), \tag{34}$$

with B being an integer denoting the history length (HL). The collection $C(\tau)$ may be updated by the Reflector at each time-frame and the resulting histogram may be smoothed by convolving it with a smooth kernel function (such as a rectangular window). Assuming that the number of sources L is known, the Reflector selects the L highest peaks from the histogram under the constraint that they are "distant-enough", i.e. separated by a user-defined threshold dA.

The block diagram for DOA estimation in 2D is depicted in FIG. 2. As noted previously, one variant that may be used by the Reflector when calculating the half-space propagation model is to consider that h(ω) is real and constant with frequency. On the other hand, the Reflector may estimate h(ω) as a function of the frequency based on the reflectivity estimation method previously described.

In the general case, one assumes the presence of L simultaneous sources at locations $(\theta_l, \psi_l)$, $l=1, \ldots, L$ which are already known based on the previously described DOA estimation approach. The output of the lth beamformer which is steered at the lth sound source direction reads $$Y_l(\tau,\omega)=w_l(\omega)^H x(\tau,\omega). \tag{35}$$

where $w_l(\omega)$ are the complex beamformer weights responsible for the lth source. Using the superdirective technique, the weights for the beamformer responsible for the lth source are derived as $$w_l^{(\lambda)}(\omega) = \frac{(Q(\omega)+\lambda I)^{-1} a(\omega, \theta_l, \psi_l)}{a^H(\omega, \theta_l, \psi_l)(Q(\omega)+\lambda I)^{-1} a(\omega, \theta_l, \psi_l)} \tag{36}$$

where λ is a scalar which can be associated with the White Noise Gain (WNG) constraint in the sense that the WNG increases monotonically with increasing λ.

Alternatively, using the MVDR beamforming technique, the Reflector may derive the signal responsible for the lth source as $$Y_l(\tau, \omega) = \frac{a^H(\omega, \theta_l, \psi_l)\left(\hat{R}(\tau, \omega)+\lambda I\right)^{-1} x(\tau, \omega)}{a^H(\omega, \theta_l, \psi_l)\left(\hat{R}(\tau, \omega)+\lambda I\right)^{-1} a(\omega, \theta_l, \psi_l)} \tag{37}$$

where $\hat{R}(\tau, \omega)$ is the signal empirical covariance matrix of Eq. (25) and λ>0 is again a scalar used for diagonal loading.

The novel version of superdirective beamforming described here is named half-space superdirective beamforming and is implemented using the half-space propagation model of Eq. (3) as a and the half-space spatial coherence model of Eq. (11) as Q in Eq. (36).

It is well known that speech signals have a sparse and varying nature across frequency and time, which makes it unlikely that two concurrent speech signals will carry significant energy at the same time-frequency (TF) point. The Reflector can exploit this fact to construct a filter to post-process the beamformer output signals to improve separation of the different sources In particular, the Reflector may consider the L masking postfilters F (τ, ω)

$$F_l = \begin{cases} 1-a, & \text{if } |Y_l(\tau, \omega)| > |Y_{l'}(\tau, \omega)|, \forall\, l' \neq l \\ a, & \text{otherwise} \end{cases} \tag{38}$$

with a∈[0, 1) a free parameter. The post filter may be used to multiply the L beamformer output signals as $Z_l(\tau, \omega)=Y_l(\tau, \omega)F(\tau, \omega)$. In the case of a=0, the resulting signals $Z_l(\tau, \omega)$, l=1, . . . , L are orthogonal to one-another and the interference of one source into the other is significantly reduced. However, other types of post filters may also be applied by the Reflector.

The block diagram for source enhancement and separation is depicted in FIG. 3. As noted above, one variant that may be used by the Reflector when calculating the half-space propagation and the corresponding half-space coherence model is to consider that h(ω) is real and constant with frequency. On the other hand, h(ω) can be estimated as a function of the frequency based on the reflectivity estimation method described above.

Figure 7:
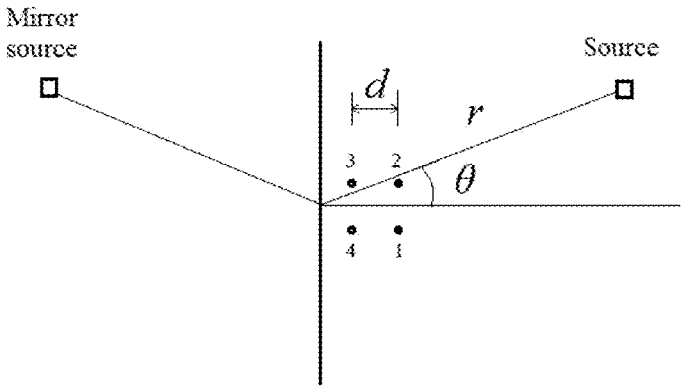
FIG. 7 is shows an exemplary configuration that may be used for validating the methods and systems described in this specification, where the location of the actual source and the mirror source are shown with squares, the microphones with dots.

The validity of the methods used by the Reflector can be illustrated using the following example, where a single sound source is located in front of an infinite reflective plane. Based on the mirror source model, the sound field at the sensors is synthesized in the time domain, by accounting for a point source and its mirror image with respect to the reflective plane, assuming that we have a perfect specular reflection. Instead of using only two sensors, the Reflector considers the square sensor array shown in FIG. 7. This four-sensor array is representative of the more general category of circular sensor arrays, which are suitable for both reflectivity estimation and DOA estimation, following the methodology presented in this specification.

A slight adaptation of the way the second order statistics are calculated is allowed by the Reflector based on the far field assumption, i.e., that the dimensions of the array are small in comparison to the distance r from the source to the center of the sensor array. The previously mentioned auto- and cross-spectra terms can thus be measured by simply averaging the information from properly matched sensor pairs as $$\hat{\Phi}_{a,a}=0.5(\hat{\Phi}_{1,1}+\hat{\Phi}_{2,2}), \tag{39}$$

$$\hat{\Phi}_{b,b}=0.5(\hat{\Phi}_{3,3}+\hat{\Phi}_{4,4}), \tag{40}$$

and $$\hat{\Phi}_{a,b}=0.5(\hat{\Phi}_{1,4}+\hat{\Phi}_{2,3}). \tag{41}$$

The method of the previous section can now be applied in order to estimate the MSRG at each frequency. For this example, the source signal is a six-second male speech signal at a distance of r=2 m from the array and at an angle of $\theta_{tr}$=20 degrees. Spherical isotropic noise is added to the sensors signals forming a signal-to-noise ration (SNR) equal to approximately 25 dB, as measured on the first sensor.

Figure 8:
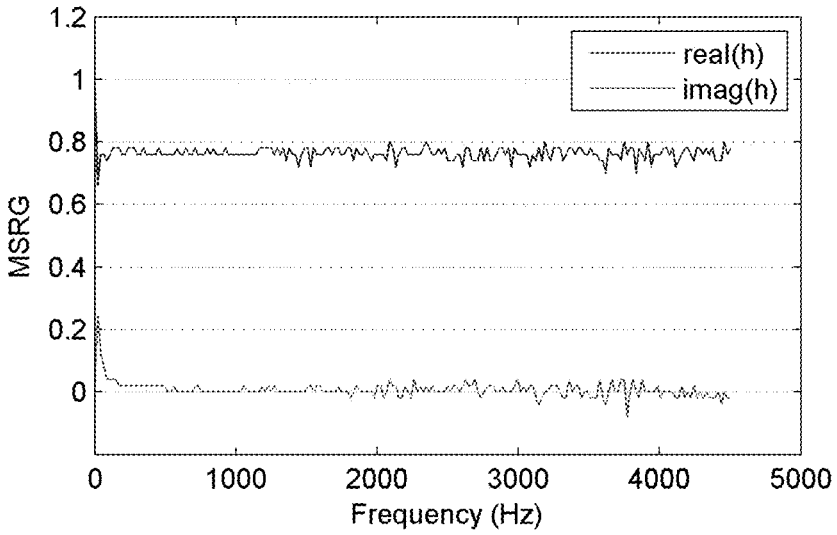
FIG. 8 is a graph showing estimated values of mirror source relative gain as a function of frequency.
Figure 9:
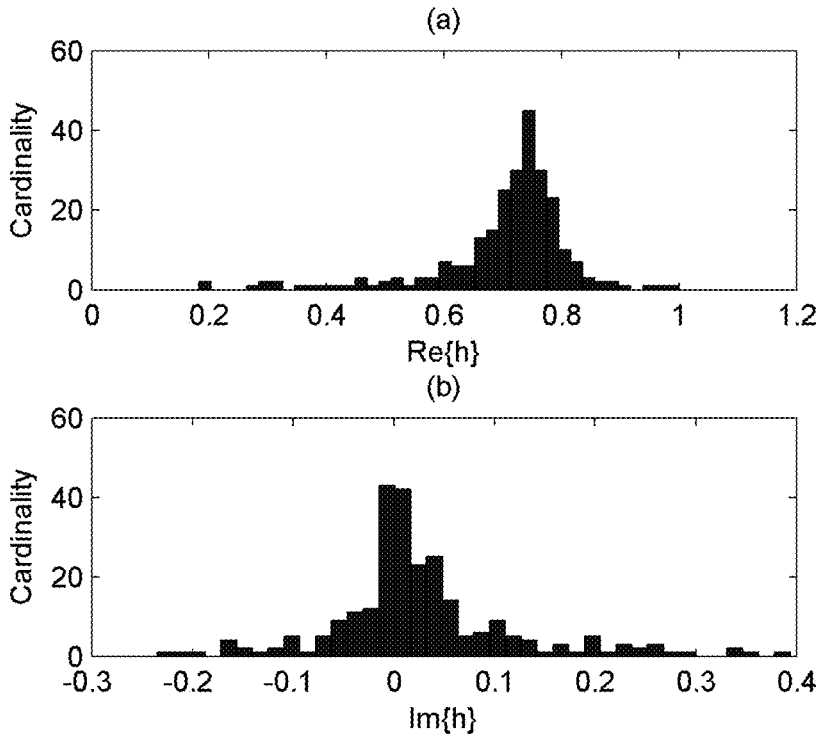
FIG. 9 is a histogram showing the real portion of the estimated mirror source relative gain (MSRG) values in (a) and the imaginary portion of the estimated MSRG values in (b)

The MSRG is set to the value of 0.8 for all frequencies and the procedure described above with regard to reflectivity estimation is applied across a continuous range of frequencies from 60 to 4500 Hz. The real and imaginary part of the estimated MSRG $\tilde{h}(\omega)$ is shown in FIG. 8 (the upper line being the real part and the lower line being the imaginary part). As it can be seen, the real part of the estimated MSRG is slightly underestimated which is a consequence of the spreading attenuation of the model which is not accounted for in the model. Additionally, some fluctuations are observed in both the real and imaginary parts of the MSRG which is a consequence of additive noise. The histogram corresponding to the locally estimated MSRGs, $\Re[\hat{h}(\tau, \omega)]$ and $\Im[\hat{h}(\tau, \omega)]$ is shown in FIG. 9 for 1873 Hz. It can be seen that the local MSRG values are well clustered around their actual values of 0.8 and 0.

Figure 10:
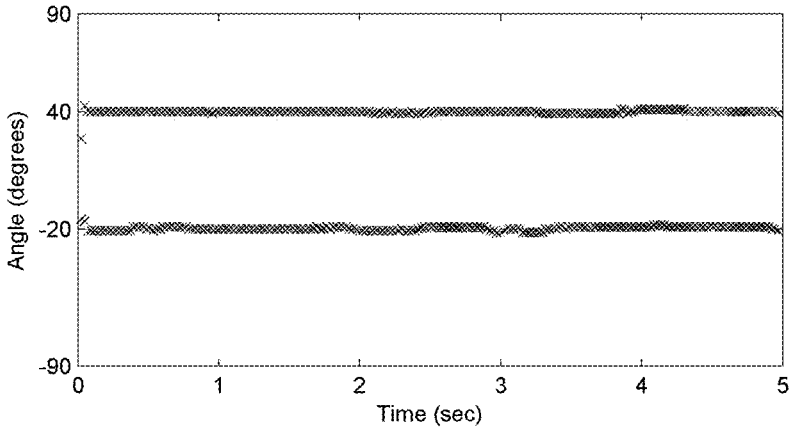
FIG. 10 is a graph showing estimated direction of arrivals (DOAs) in degrees as a function of time.

Using the estimated MSRGs, the Reflector may apply the method described above to estimate the DOAs of two active sources in front of the array. For this example, the sources are a male and a female speaker at −20 and 40 degrees respectively, both at a distance of r=1.2 m from the center of the coordinate system. Note that the speech signals used for this experiment are different from the one used for system identification. Spherical isotropic noise is added to the sensors signals forming an SNR equal to 20 dB approximately, as measured on the first sensor. For DOA estimation the Reflector has used the entire frequency range from 60 to 4500 Hz, a history length of B=20 time frames and has assumed a known number of sources L=2. The source DOAs are estimated by processing the estimates in the set C(τ) as follows; at each time frame, the Reflector forms a histogram and finds the angle bin $\theta_n$ corresponding to the highest cardinality value. The Reflectors sets the DOA of the first source to that value and then searches for the second highest peak, excluding all angle bins which are in a range ±20° from the angle of the first peak. The Reflector then set the DOA of the second source to the angle bin corresponding to the second peak. The results of DOA estimation are shown in FIG. 10 as a function of time. It can be seen that both sources are correctly localized throughout the entire time range.

Reflector Controller

Figure 11:
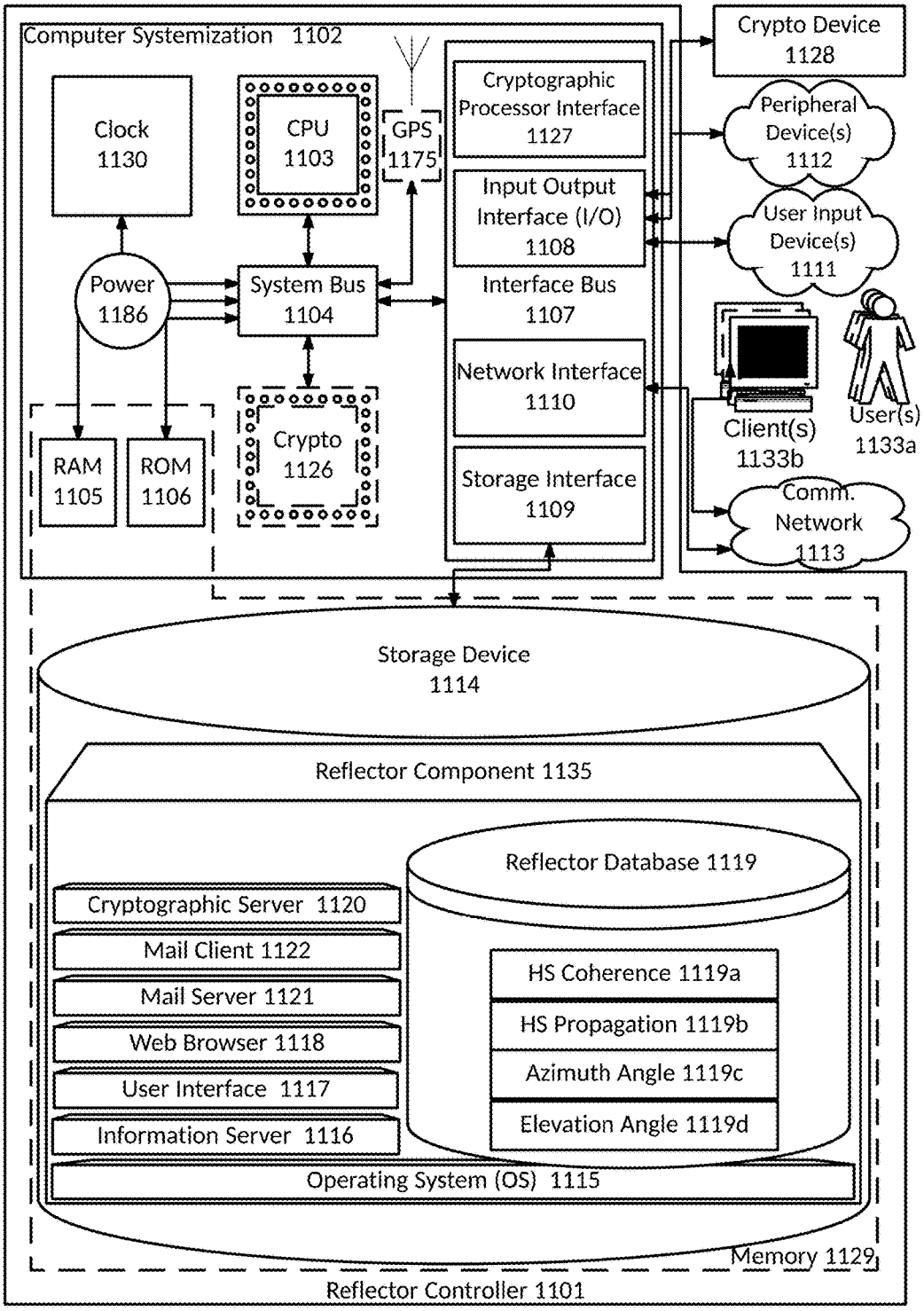
FIG. 11 is a block diagram illustrating exemplary embodiments of a Reflector controller.

FIG. 11 illustrates inventive aspects of a Reflector controller 1101 in a block diagram. In this embodiment, the Reflector controller 1101 may serve to provide sound-source enhancement and other signal-processing functions.

Typically, users, which may be people and/or other systems, may engage information technology systems (e.g., computers) to facilitate information processing. In turn, computers employ processors to process information; such processors 1103 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 1129 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the Reflector controller 1101 may be connected to and/or communicate with entities such as, but not limited to: one or more users from user input devices 1111; peripheral devices 1112; an optional cryptographic processor device 1128; and/or a communications network 1113.

Networks are commonly thought to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." The term "client" as used herein refers generally to a computer, program, other device, user and/or combination thereof that is capable of processing and making requests and obtaining and processing any responses from servers across a communications network. A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The Reflector controller 1101 may be based on computer systems that may comprise, but are not limited to, components such as: a computer systemization 1102 connected to memory 1129.

Computer Systemization

A computer systemization 1102 may comprise a clock 1130, central processing unit ("CPU(s)" and/or "processor(s)" (these terms are used interchangeable throughout the disclosure unless noted to the contrary)) 1103, a memory 1129 (e.g., a read only memory (ROM) 1106, a random access memory (RAM) 1105, etc.), and/or an interface bus 1107, and most frequently, although not necessarily, are all interconnected and/or communicating through a system bus 1104 on one or more (mother)board(s) 1102 having conductive and/or otherwise transportive circuit pathways through which instructions (e.g., binary encoded signals) may travel to effect communications, operations, storage, etc. Optionally, the computer systemization may be connected to an internal power source 1186. Optionally, a cryptographic processor 1126 may be connected to the system bus. The system clock typically has a crystal oscillator and generates a base signal through the computer systemization's circuit pathways. The clock is typically coupled to the system bus and various clock multipliers that will increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. Of course, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves will incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 1129 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the Reflector controller and beyond through various interfaces. Should processing requirements dictate a greater amount speed and/or capacity, distributed processors (e.g., Distributed Reflector), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the Reflector may be achieved by implementing a microcontroller such as CAST's R8051XC2 microcontroller; Intel's MCS 51 (i.e., 8051 microcontroller); and/or the like. Also, to implement certain features of the Reflector, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the Reflector component collection (distributed or otherwise) and/or features may be implemented via the microprocessor and/or via embedded components; e.g., via ASIC, coprocessor, DSP, FPGA, and/or the like. Alternately, some implementations of the Reflector may be implemented with embedded components that are configured and used to achieve a variety of features or signal processing.

Depending on the particular implementation, the embedded components may include software solutions, hardware solutions, and/or some combination of both hardware/software solutions. For example, Reflector features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of the Reflector features. A hierarchy of programmable interconnects allow logic blocks to be interconnected as needed by the Reflector system designer/administrator, somewhat like a one-chip programmable breadboard. An FPGA's logic blocks can be programmed to perform the function of basic logic gates such as AND, and XOR, or more complex combinational functions such as decoders or simple mathematical functions. In most FPGAs, the logic blocks also include memory elements, which may be simple flip-flops or more complete blocks of memory. In some circumstances, the Reflector may be developed on regular FPGAs and then migrated into a fixed version that more resembles ASIC implementations. Alternate or coordinating implementations may migrate Reflector controller features to a final ASIC instead of or in addition to FPGAs. Depending on the implementation all of the aforementioned embedded components and microprocessors may be considered the "CPU" and/or "processor" for the Reflector.

Power Source

The power source 1186 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 1186 is connected to at least one of the interconnected subsequent components of the Reflector thereby providing an electric current to all subsequent components. In one example, the power source 1186 is connected to the system bus component 1104. In an alternative embodiment, an outside power source 1186 is provided through a connection across the I/O 1108 interface. For example, a USB and/or IEEE 1394 connection carries both data and power across the connection and is therefore a suitable source of power.

Interface Adapters

Interface bus(ses) 1107 may accept, connect, and/or communicate to a number of interface adapters, conventionally although not necessarily in the form of adapter cards, such as but not limited to: input output interfaces (I/O) 1108, storage interfaces 1109, network interfaces 1110, and/or the like. Optionally, cryptographic processor interfaces 1127 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 1109 may accept, communicate, and/or connect to a number of storage devices such as, but not limited to: storage devices 1114, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 1110 may accept, communicate, and/or connect to a communications network 1113. Through a communications network 1113, the Reflector controller is accessible through remote clients 1133*b* (e.g., computers with web browsers) by users 1133*a*. Network interfaces may employ connection protocols such as, but not limited to: direct connect, Ethernet (thick, thin, twisted pair 10/100/1000 Base T, and/or the like), Token Ring, wireless connection such as IEEE 802.11a-x, and/or the like. Should processing requirements dictate a greater amount speed and/or capacity, distributed network controllers (e.g., Distributed Reflector), architectures may similarly be employed to pool, load balance, and/or otherwise increase the communicative bandwidth required by the Reflector controller. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 1110 may be used to engage with various communications network types 1113. For example, multiple network interfaces may be employed to allow for the communication over broadcast, multicast, and/or unicast networks.

Input Output interfaces (I/O) 1108 may accept, communicate, and/or connect to user input devices 1111, peripheral devices 1112, cryptographic processor devices 1128, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless: 802.11a/b/g/n/x, Bluetooth, code division multiple access (CDMA), global system for mobile communications (GSM), WiMax, etc.; and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 1111 may be card readers, dongles, finger print readers, gloves, graphics tablets, joysticks, keyboards, mouse (mice), remote controls, retina readers, trackballs, trackpads, and/or the like.

Peripheral devices 1112 may be connected and/or communicate to I/O and/or other facilities of the like such as network interfaces, storage interfaces, and/or the like. Peripheral devices may be audio devices, cameras, dongles (e.g., for copy protection, ensuring secure transactions with a digital signature, and/or the like), external processors (for added functionality), goggles, microphones, monitors, network interfaces, printers, scanners, storage devices, video devices, video sources, visors, and/or the like.

It should be noted that although user input devices and peripheral devices may be employed, the Reflector controller may be embodied as an embedded, dedicated, and/or monitor-less (i.e., headless) device, wherein access would be provided over a network interface connection.

Cryptographic units such as, but not limited to, microcontrollers, processors 1126, interfaces 1127, and/or devices 1128 may be attached, and/or communicate with the Reflector controller. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of CPU. Equivalent microcontrollers and/or processors may also be used. Other commercially available specialized cryptographic processors include: the Broadcom's CryptoNetX and other Security Processors; nCipher's nShield, SafeNet's Luna PCI (e.g., 7100) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2100, L2200, U2400) line, which is capable of performing 500+MB/s of cryptographic instructions; VLSI Technology's 33 MHz 6868; and/or the like.

Memory

Generally, any mechanization and/or embodiment allowing a processor to affect the storage and/or retrieval of information is regarded as memory 1129. However, memory is a fungible technology and resource, thus, any number of memory embodiments may be employed in lieu of or in concert with one another. It is to be understood that the Reflector controller and/or a computer systemization may employ various forms of memory 1129. For example, a computer systemization may be configured wherein the functionality of on-chip CPU memory (e.g., registers), RAM, ROM, and any other storage devices are provided by a paper punch tape or paper punch card mechanism; of course such an embodiment would result in an extremely slow rate of operation. In a typical configuration, memory 1129 will include ROM 1106, RAM 1105, and a storage device 1114. A storage device 1114 may be any conventional computer system storage. Storage devices may include a drum; a (fixed and/or removable) magnetic disk drive; a magneto-optical drive; an optical drive (i.e., Blueray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 1129 may contain a collection of program and/or database components and/or data such as, but not limited to: operating system component(s) 1115 (operating system); information server component(s) 1116 (information server); user interface component(s) 1117 (user interface); Web browser component(s) 1118 (Web browser); Reflector database(s) 1119; mail server component(s) 1121; mail client component(s) 1122; cryptographic server component(s) 1120 (cryptographic server); the Reflector component(s) 1135; and/or the like (i.e., collectively a component collection). These components may be stored and accessed from the storage devices and/or from storage devices accessible through an interface bus. Although non-conventional program components such as those in the component collection, typically, are stored in a local storage device 1114, they may also be loaded and/or stored in memory such as: peripheral devices, RAM, remote storage facilities through a communications network, ROM, various forms of memory, and/or the like.

Operating System

The operating system component 1115 is an executable program component facilitating the operation of the Reflector controller. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the Reflector controller to communicate with other entities through a communications network 1113. Various communication protocols may be used by the Reflector controller as a subcarrier transport mechanism for interaction, such as, but not limited to: multicast, TCP/IP, UDP, unicast, and/or the like.

Information Server

An information server component 1116 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective–) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HITPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the Reflector controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the Reflector database 1119, operating systems, other program components, user interfaces, Web browsers, and/or the like.

Access to the Reflector database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the Reflector. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the Reflector as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

The function of computer interfaces in some respects is similar to automobile operation interfaces. Automobile operation interface elements such as steering wheels, gearshifts, and speedometers facilitate the access, operation, and display of automobile resources, functionality, and status. Computer interaction interface elements such as check boxes, cursors, menus, scrollers, and windows (collectively and commonly referred to as widgets) similarly facilitate the access, operation, and display of data and computer hardware and operating system resources, functionality, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 1117 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 1118 is a stored program component that is executed by a CPU. The Web browser may be a conventional hypertext viewing application such as Microsoft Internet Explorer or Netscape Navigator. Secure Web browsing may be supplied with 128 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Of course, in place of a Web browser and information server, a combined application may be developed to perform similar functions of both. The combined application would similarly affect the obtaining and the provision of information to users, user agents, and/or the like from the Reflector enabled nodes. The combined application may be nugatory on systems employing standard Web browsers.

Mail Server

A mail server component 1121 is a stored program component that is executed by a CPU 1103. The mail server may be a conventional Internet mail server such as, but not limited to sendmail, Microsoft Exchange, and/or the like. The mail server may allow for the execution of program components through facilities such as ASP, ActiveX, (ANSI) (Objective–) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the Reflector.

Access to the Reflector mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component is a stored program component that is executed by a CPU 1103. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component is a stored program component that is executed by a CPU 1103, cryptographic processor 1126, cryptographic processor interface 1127, cryptographic processor device 1128, and/or the like. Cryptographic processor interfaces will allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component will facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash function), passwords, Rivest Cipher (RC5), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the Reflector may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption schemes allowing for the secure transmission of information across a communications network to enable the Reflector component to engage in secure transactions if so desired. The cryptographic component facilitates the secure accessing of resources on the Reflector and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

The Reflector Database

The Reflector database component 1119 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the Reflector database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of functionality encapsulated within a given object. If the Reflector database is implemented as a data-structure, the use of the Reflector database 1119 may be integrated into another component such as the Reflector component 1135. Also, the database may be implemented as a mix of data structures, objects, and relational structures. Databases may be consolidated and/or distributed in countless variations through standard data processing techniques. Portions of databases, e.g., tables, may be exported and/or imported and thus decentralized and/or integrated.

In one embodiment, the database component 1119 includes several tables 1119*a-e*, including a half_space_coherence_index table 1119*a*, a half_space_propagation_index table 1119*b*, an azimuth_angle table 1119*c*, and an elevation_angle table 1119*d*.

In one embodiment, the Reflector database may interact with other database systems. For example, employing a distributed database system, queries and data access by search Reflector component may treat the combination of the Reflector database, an integrated data security layer database as a single database entity.

In one embodiment, user programs may contain various user interface primitives, which may serve to update the Reflector. Also, various accounts may require custom database tables depending upon the environments and the types of clients the Reflector may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 1119*a-d*. The Reflector may be configured to keep track of various settings, inputs, and parameters via database controllers.

The Reflector database may communicate to and/or with other components in a component collection, including itself, and/or facilities of the like. Most frequently, the Reflector database communicates with the Reflector component, other program components, and/or the like. The database may contain, retain, and provide information regarding other nodes and data. The Reflectors The Reflector component 1135 is a stored program component that is executed by a CPU. In one embodiment, the Reflector component incorporates any and/or all combinations of the aspects of the Reflector that was discussed in the previous figures. As such, the Reflector affects accessing, obtaining and the provision of information, services, transactions, and/or the like across various communications networks.

The Reflector component enables the determination of weights for constituents of index-linked financial portfolios, the acquisition and/or maintenance/management of those constituents, the determination of market values and/or returns associated with the indices, the generation of financial products based on the indices, and/or the like and use of the Reflector.

The Reflector component enabling access of information between nodes may be developed by employing standard development tools and languages such as, but not limited to: Apache components, Assembly, ActiveX, binary executables, (ANSI) (Objective–) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the Reflector server employs a cryptographic server to encrypt and decrypt communications. The Reflector component may communicate to and/or with other components in a component collection, including itself, and/or facilities of the like. Most frequently, the Reflector component communicates with the Reflector database, operating systems, other program components, and/or the like. The Reflector may contain, communicate, generate, obtain, and/or provide program component, system, user, and/or data communications, requests, and/or responses.

Distributed Reflectors

The structure and/or operation of any of the Reflector node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the Reflector controller will depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), local and remote application program interfaces Jini, Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using standard development tools such as lex, yacc, XML, and/or the like, which allow for grammar generation and parsing functionality, which in turn may form the basis of communication messages within and between components. For example, a grammar may be arranged to recognize the tokens of an HTTP post command, e.g.:

w3c-post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., the SOAP parser) that may be employed to parse (e.g., communications) data. Further, the parsing grammar may be used beyond message parsing, but may also be used to parse: databases, data collections, data stores, structured data, and/or the like. Again, the desired configuration will depend upon the context, environment, and requirements of system deployment.

To address various issues related to, and improve upon, previous work, the application is directed to DIRECTION OF ARRIVAL ESTIMATION AND SIGNAL ENHANCEMENT IN THE PRESENCE OF A REFLECTIVE SURFACE APPARATUSES, METHODS, AND SYSTEMS. The entirety of this application (including the Cover Page, Title, Headings, Field, Background, Summary, Brief Description of the Drawings, Detailed Description, Claims, Abstract, Figures, Appendices, and any other portion of the application) shows by way of illustration various embodiments. The advantages and features disclosed are representative; they are not exhaustive or exclusive. They are presented only to assist in understanding and teaching the claimed principles. It should be understood that they are not representative of all claimed inventions. As such, certain aspects of the invention have not been discussed herein. That alternate embodiments may not have been presented for a specific portion of the invention or that further undescribed alternate embodiments may be available for a portion of the invention is not a disclaimer of those alternate embodiments. It will be appreciated that many of those undescribed embodiments incorporate the same principles of the invention and others are equivalent. Thus, it is to be understood that other embodiments may be utilized and functional, logical, organizational, structural and/or topological modifications may be made without departing from the scope of the invention. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the invention, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like. As such, it should be understood that advantages, embodiments, examples, functionality, features, logical aspects, organizational aspects, structural aspects, topological aspects, and other aspects of the disclosure are not to be considered limitations on the disclosure as defined by the claims or limitations on equivalents to the claims.

Depending on the particular needs and/or characteristics of an Reflector user, various embodiments of the Reflector may be implemented that enable a great deal of flexibility and customization. However, it is to be understood that the apparatuses, methods and systems discussed herein may be readily adapted and/or reconfigured for a wide variety of other applications and/or implementations. The exemplary embodiments discussed in this disclosure are not mutually exclusive and may be combined in any combination to implement the functions of the Reflector.

The invention claimed is:

1. A processor-implemented method for sound-source enhancement in the presence of a reflective surface, the method comprising:

capturing a signal from a sound source using a sensor array having a plurality of sensors, the sensor array being positioned between the sound source and the reflective surface;

calculating a half-space propagation model by determining a modified steering vector associated with a plane sound wave produced by the sound source as a function of signal direction and a reflectivity value;

calculating a half-space spatial coherence model by dividing a sphere with its center on the reflective surface into two mirror symmetric parts intersected by a plane to create two half spheres and accounting for a finite number of uniformly distributed plane wave sources originating from a surface of a half sphere of the two half spheres which includes the sensor array by considering a uniform distribution of plane wave sources on the half sphere and letting a signature of each plane wave be expressed by the half-space propagation model;

creating a half-space signal-enhancement module using the half-space propagation model and the half-space spatial coherence model; and applying the half-space signal-enhancement module to the signal to enhance the signal.

2. The method of claim 1, wherein the signal is a plurality of signals, and wherein the method further comprises applying a filter to the plurality of signals to increase separation of the signals.

3. The method of claim 1, wherein the signal-enhancement module is a beamformer.

4. The method of claim 1, wherein the reflectivity value is assumed to be constant with frequency.

5. The method of claim 1, further comprising calculating the reflectivity value by:

treating the sound source as a single source at a known direction with respect to an acoustic center for the sound source;

defining a model of auto-spectra and inter-channel cross-spectra terms for the single source as a function of a frequency of the sound source; and estimating g mirror source relative gain at a plurality of time-frequency points based on the model.

6. The method of claim 5, further comprising using an auxiliary function and forming a histogram from time-frequency estimates of reflectivity values to estimate a final reflectivity value.

7. The method of claim 1, wherein the signal direction is received at the signal enhancement module from an external direction-of-arrival (DOA) module.

8. The method of claim 1, further comprising deriving the signal direction by:

estimating a direction of arrival (DOA) of the sound source by using a predefined grid search to find a plurality of DOAs by finding the most energetic DOA at each time-frequency point;

processing the plurality of DOAs across time to form a histogram; and localizing the most prominent peaks in the histogram.

9. A system for sound-source enhancement in the presence of a reflective surface, the system comprising:

a sensor array having a plurality of sensors, the sensor array being positioned between a sound source and the reflective surface;

a half-space signal enhancer configured to:

calculate a half-space propagation model by determining a modified steering vector associated with a plane sound wave produced by the sound source as a function of signal direction and a reflectivity value;

calculate half-space spatial coherence model by dividing a sphere with its center on the reflective surface into two mirror symmetric parts intersected by a plane to create two half spheres and accounting for a finite number of uniformly distributed plane wave sources originating from a surface of a half sphere of the two half spheres which includes the sensor array by considering a uniform distribution of plane wave sources on the half sphere and letting a signature of each plane wave be expressed by the half-space propagation model;

enhance the signal based on the half-space propagation model and the half-space coherence model.

10. The system of claim 9, wherein the signal is a plurality of signals, and wherein the system is further configured to apply a filter to the plurality of signals to increase separation of the signals.

11. The system of claim 9, wherein the signal enhancer is a beamformer.

12. The system of claim 9, wherein the reflectivity value is assumed to be constant with frequency.

13. The system of claim 9, wherein the half-space signal enhancer is further configured to:

treat the sound source as a single source at a known direction with respect to an acoustic center for the sound source;

define a model of auto-spectra and inter-channel cross-spectra terms for the single source as a function of a frequency of the sound source; and estimate a mirror source relative gain at a plurality of time-frequency points based on the model.

14. The system of claim 13 wherein the half-space signal enhancer is further configured to use an auxiliary function and form a histogram from time-frequency estimates of reflectivity values to estimate a final reflectivity value.

15. The system of claim 9, wherein the signal direction is received at the signal enhancer from a direction-of-arrival module external to the signal enhancer.

16. The system of claim 9, wherein the signal enhancer is configured to derive the signal direction by:

estimating a direction of arrival (DOA) of the sound source by using a predefined grid search to find a plurality of DOAs by finding the most energetic DOA at each time-frequency point;

processing the plurality of DOAs across time to form a histogram; and localizing the most prominent peaks in the histogram.

17. A processor-readable non-transitory tangible medium for sound-source enhancement in the presence of a reflective surface, the medium storing processor-issuable-and-generated instructions to:

capture a signal from a sound source using a sensor array having a plurality of sensors, the sensor array being positioned between the sound source and the reflective surface at a predetermined distance from the reflective surface;

calculate a half-space propagation model by determining a modified steering vector associated with a plane sound wave produced by the sound source as a function of signal direction and a reflectivity value;

calculate a half-space spatial coherence model by dividing a sphere with its center on the reflective surface into two mirror symmetric parts intersected by a plane to create two half spheres and accounting for a finite number of uniformly distributed plane wave sources originating from a surface of a half sphere of the two half spheres which includes the sensor array by considering a uniform distribution of plane wave sources on the half sphere and letting g signature of each plane wave be expressed by the half-space propagation model;

create a half-space signal-enhancement module using the half-space propagation model and the half-space coherence model; and apply the half-space signal-enhancement module to the signal to enhance the signal.

18. The processor-readable tangible medium of claim 17, wherein the medium includes processor-issuable-and-generated instructions to:

treat the sound source as a single source at a known direction with respect to an acoustic center for the sound source;

define a model of auto-spectra and inter-channel cross-spectra terms for the single source as a function of a frequency of the sound source; and estimate 8 mirror source relative gain at a plurality of time-frequency points based on the model.

19. The processor-readable tangible medium of claim 17, wherein the medium includes processor-issuable-and-generated instructions to:

estimate a direction of arrival (DOA) of the sound source by using a predefined grid search to find a plurality of DOAs by finding the most energetic DOA at each time-frequency point;

process the plurality of DOAs across time to form a histogram; and localize the most prominent peaks in the histogram.

20. The processor-readable tangible medium of claim 17, wherein the medium includes processor-issuable-and-generated instructions to apply a filter to a plurality of signals to increase separation of the signals.

* * * * *